United States Patent [19]

Haffner

[11] Patent Number: 4,846,361

[45] Date of Patent: Jul. 11, 1989

[54] TAMPER-INDICATING CLOSURE FOR A CONTAINER AND IMPROVED CAPPING WITHOUT TOP LOADING

[75] Inventor: Eugene F. Haffner, Maumee, Ohio

[73] Assignee: Owens-Illinois Closure Inc., Toledo, Ohio

[21] Appl. No.: 226,496

[22] Filed: Aug. 1, 1988

[51] Int. Cl.[4] ..... B65D 41/34

[52] U.S. Cl. ..... 215/252; 53/488; 53/490; 215/258

[58] Field of Search ..... 215/252, 253, 258; 53/488, 490, 485

[56] References Cited

U.S. PATENT DOCUMENTS

| | | | |
|---|---|---|---|
| 4,147,268 | 4/1979 | Patel et al. | 215/252 |
| 4,488,655 | 12/1984 | Itsubo et al. | 215/252 |
| 4,753,360 | 6/1988 | Baxter | 215/252 |

*Primary Examiner*—Donald F. Norton

[57] ABSTRACT

A one-piece molded plastic closure having a tamper-indicating band connected to the closure skirt by rupturable means. The tamper band uses series of solid interiorly projecting beads that come in contact with a transfer bead on the container as the closure is unscrewed. The engagement of the beads and container breaks the band by rupture on the connection means. The beads in the band are arranged in tiers at three different heights on the band. A thick cylindrical section at the bottom of the band assists initial capping. The beads are disposed in the band at an angle equal to the pitch angle of the container threads. This eliminates need for top pressure in capping by the beads following the container thread lowering and driving the beads over the container's transfer bead locking the band in place.

22 Claims, 3 Drawing Sheets

TAMPER-INDICATING CLOSURE FOR A CONTAINER AND IMPROVED CAPPING WITHOUT TOP LOADING

BACKGROUND OF THE INVENTION

The invention relates to tamper-indicating closures and their use with containers.

Plastic closures have been used which provide a tamper band portion affixed to the lower free edge of the closure skirt by weakened means integral with the closure which cause the band to be severed from the closure skirt when the applied closure is unscrewed or lifted on the container neck finish. The container is provided with screw threads on its neck finish adjacent the container opening and below the thread portion is an annular external ring or bead. In some prior closures of this type the band includes flexible portions, such as wings, along its inner surface which deflect over the container bead until they are beneath it. The deflection arises in on-screwing the closure, however, unscrewing the closure results in engagement with the bead without deflection causing the band to be severed from the remainder of the closure and this severance indicates that the closure has been initially opened. Examples of such tamper-indicating closures found in the prior art disclosed by U.S. Pat. Nos. 4,497,765, 4,520,939 and 4,592,476. To close the mouth at the neck of the container, the threads of the closure travel over the threads of the neck finish in the onscrewing rotation. The flexible portions are angled such that they ride over the container bead and move below it to the closed position on the container. Upon rotation in the unscrewing direction, the flexible portions extend inwardly and do not deflect over the finish bead so that the upward movement of the band is intefered with by the flexible portion. The tamper band cannot move upwardly with the closure and the stress created by the interference breaking the band from the skirt.

The angled flexible wings may be defeated from their normal function by inserting a thin member, such as shim stock or the like, between the band and the container and manipulating the wings in the opposite direction. Thereafter, unscrewing the closure produces the reaction normally obtained in onscrewing the closure in which the wings deflect over the annular bead on the container without the tamper band being broken away. Thus the guarantee of the package against tampering is defeated.

The application of closures on a container finish in which the lowermost tamper band has inwardly extending projections on the inside surface requires top loading the closure during the onscrewing rotation to move the projections over the threads of the container finish until the closure threads and container threads are firmly engaged. The top loading requirement adds to the complexity of the capping apparatus for applying tamper-indicating closures.

SUMMARY OF THE INVENTION

It is a principal object of this invention to provide a tamper-indicating closure that is incapable of having its guarantee against tampering defeated.

It is also an object of the invention to provide a tamper-indicating closure and method of applying it that does not require top loading during the application of the closure onto a container neck finish.

A further object of the invention is to provide a closure within these objects which is easy to manufacture and economically competitive with presently available tamper-indicating closures.

And, another object of the invention is to utilize a standard threaded bottle finish having a dual transfer bead below the threads to further enhance the guarantee against tampering by providing a closure with multiple levels or tiers of beads arranged in the tamper band of the closure.

Another object of the invention is to provide a tamper-indicating band on the free edge of the closure skirt having a thickened cross-section of the band's bottom free edge to assist the initial capping off the closure on a container neck finish.

Further objects and features of the present invention are set forth in the following description and in the accompanying drawings.

DETAILED DESCRIPTION OF THE INVENTION

Figure 1:
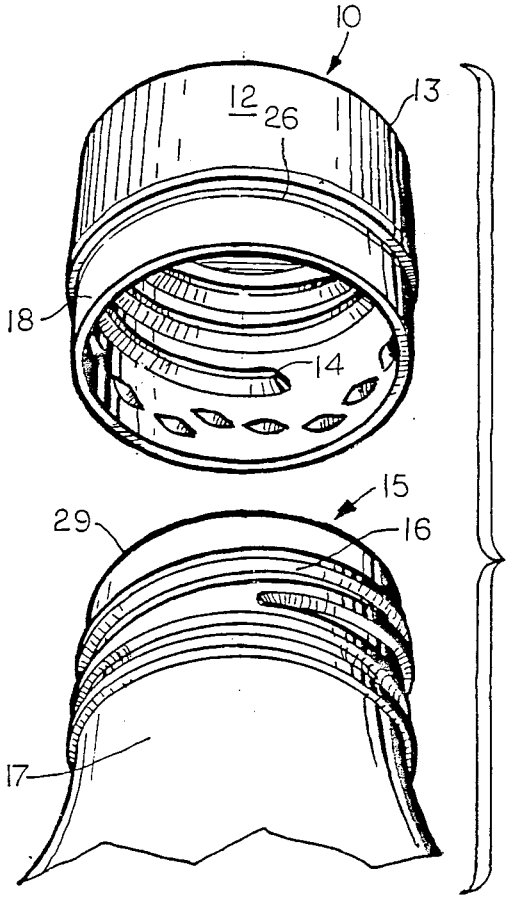
FIG. 1 is an exploded perspective view of the closure of the invention and the threaded finish of a container on which the closure is attached.
Figure 2:
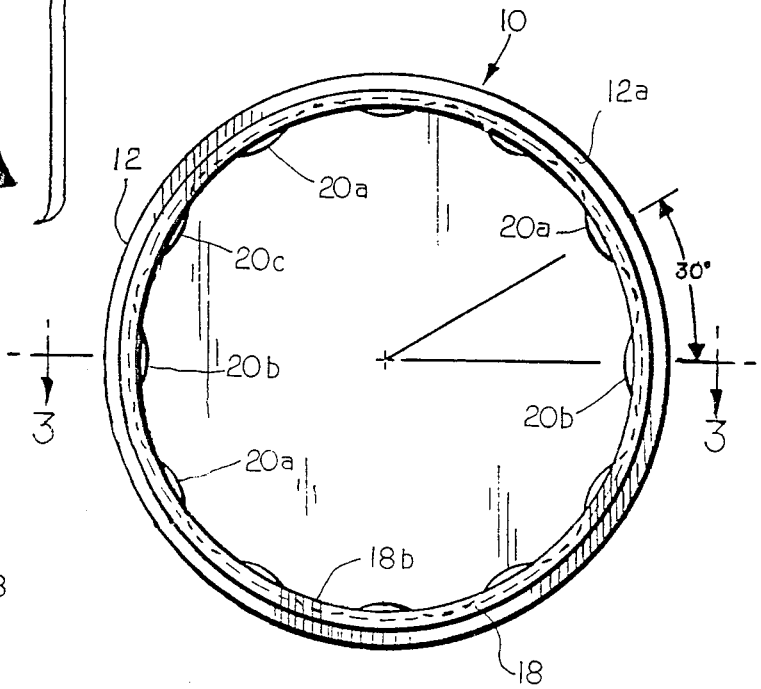
FIG. 2 is a bottom plan view of the closure.

Referring to FIGS. 1 and 2, a one-piece closure 10 is molded of plastic, such as polypropylene, and comprises a base wall 11 and a peripheral skirt 12. The skirt and base wall are joined at an upper edge radius 13. Inside skirt 12 are means such as internal threads 14 which are adapted to interengage corresponding means on a container 15 such as threads 16 along the circular upper finish 17 of container 15.

Figure 4:
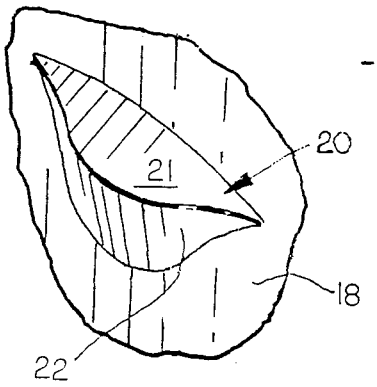
FIG. 4 is an enlarged perspective view of one of the radially projecting beads on the inside surface of the tamper-indicating band.

A tamper-indicating band portion 18 is joined to the lower edge of the skirt 12 by a rupturable means, one form being illustrated on FIGS. 1, 2 and 4 as an annular weakening provided by score line 26 cut to partial depth through the circumference, or cut alternately partial depth spans and full cut dept spans of the material of the upper part of band portion 18 and just below the lower edge of skirt 12. In this fashion, the band 18 is attached to the closure by a frangible means along a weakened line.

Figure 3:
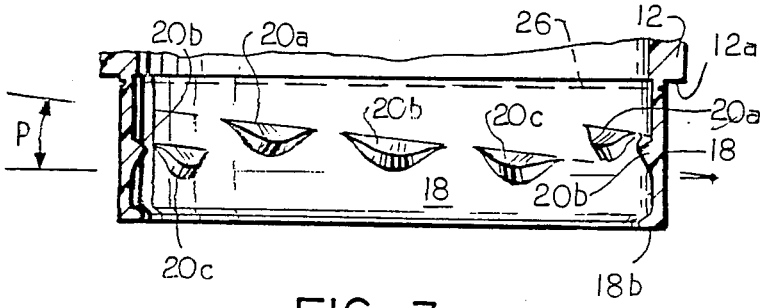
FIG. 3 is a partial sectional elevational view of the lower portion of the closure and the tamper-indicating band, taken along line 3—3 on FIG. 2.

Along the interior of band portion 18 there is formed series of inwardly facing projections, herein called "beads", 20 and arranged around the interior circumference in plural tiers or levels. The beads 20 are arranged in a series each at a different level in the band. One such series is shown on FIG. 3 indicated as 20*a*, 20*b* and 20*c*. The uppermost bead 20*a* repeats in the next adjacent series, and so forth, and the last or lowermost bead 20*c* lies adjacent an uppermost bead 20*a*. The beads 20*a*–20*c* of each series is disposed along a pitch line that is inclined by angle "p" from horizontal radial line on FIG. 3. The angle "p" will be the same as the pitch of threads of the container finish. As an example, the thread pitch angle of container threads is 20° from horizontal angled in the direction of rotation of the closure for applying it onto the container finish. As seen on FIG. 4, this pitch angle "p" is provided in the upper surface 21 of the bead 20. The compound surfaces below surface 21 extend into the wall of band and provide a cammed surface 22 that is sloped downwardly from surface 21 to meet the band wall. This compound surface 22, as it meets the surface of the threads 14 of the container, is at a much steeper angle with the horizontal. As the closure is being removed from the container, the uppermost beads 20*a* come into contact with a circumferentially disposed lower transfer bead 23 located lowermost on the bottle finish. Bead 23 provides a locking ring on the container for the tamper-indicating band of the closure. As the closure is unscrewed from the full "on" position, FIG. 5, the uppermost beads 20*a* each engage the lower transfer bead 23 at its undersurface. The gripping of beads 20*a* on the transfer bead of the container halt the lifting of the band 18 of closure 10. The annular score line of weakening, shown in the embodiment of FIGS. 1–3 and 5, will cause a rupture between band 18 and skirt 12 along score line separating the band and skirt. The closure 10 will be unscrewed from container 15 and band 18 will be retained on the neck 17 below the transfer bead 23.

Beads 20 are solid which will prevent collapsing them against the band by someone tampering with the package. The staggered tier arrangement of the beads in sets distributed circumferentially on band 12 increase the difficulty to defeat the tamper-indicating feature of the invention. The arrangement of beads 20 prevents the "tiring" of the band past the circular bead on the bottle by inserting a shim-like device between the band and container for successively displacing the beads past the retaining surface of the container. The "tiring" technique is used on some tamper-indicating closures to defeat them; that, is, remove the closure without separating the band from the closure.

As shown on the drawings, four sets of beads 20 are employed totaling 12 of beads 20 around the inside of band 18. In this arrangement, the beads are angularly arranged 30° apart, center to center. The projecting beads may vary in number and in the number in each tier or set. For the ease of application of the closure, equal angular spacing of the beads around the band is preferred.

The invention provides an advantage in capping the container. In most of the present tamper-indicating closures in use the capper must utilize an axial top pressure along with the rotary movement to apply the closure to a threaded container. The top pressure is necessary to force the tamper band devices or projections past the threads. In the present invention, the sustained top pressure by the capping head is no longer necessary because the projecting beads lie along a thread pitch line comparable with the container threads. In essence, beads 20 are arranged to thread themselves by their surface 21 riding under container threads 16 until they pass the end of the thread. At this point, the threads 14 in the closure skirt are engaged with container threads 16 and drive the closure to the full "on" position (see FIG. 5). In the downward rotary movement of the closure, the lower surface 22 of the beads 20 ride over the circumferential bead or beads on the container (see FIGS. 8–10). The preferred arrangement shown in the present disclosure provides two such annular beads on the container. The lowermost annular bead 23 is spaced below uppermost annular bead 24 along the container neck and below threads 16 thereon. The annular space between the circumferential beads 23 and 24 provides a smooth transition groove 25, the base of groove 25 being slightly greater in diameter than the container neck below bead 23. In practice, beads 23 and 24 on the container serve as transfer beads in molding the container; that is, the neck molds include the beads and the latter are used in transferring the container in the container manufacturing process. The container finish 17 should herein include the two transfer beads 23 and 24 for an advantage in providing a tamper-indicating package. Should one level of the beads 20 on the closure band be manipulated above the lower container bead 23, it will become isolated below bead 24 and is virtually assured against manipulation intact past the uppermost bead 24.

Figure 8:
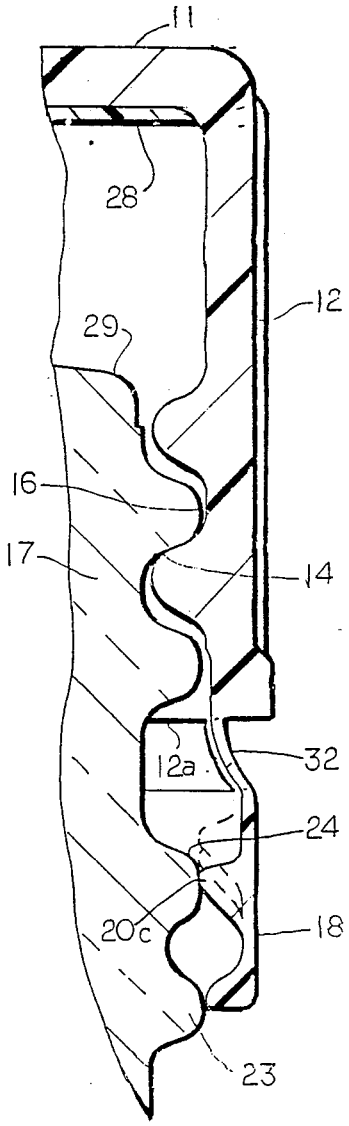
FIGS. 8–10 are sectional elevational views showing the progression of views in applying the closure on the container finish; and illustrating the succession of the three tiers of beads on the closure's tamper-indicating band engaging the transfer ring of the container finish.
Figure 9:
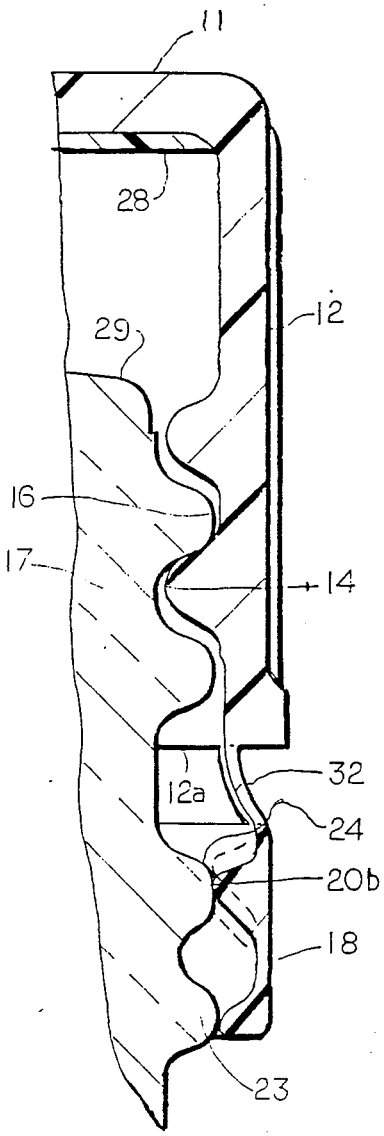
Figure 10:
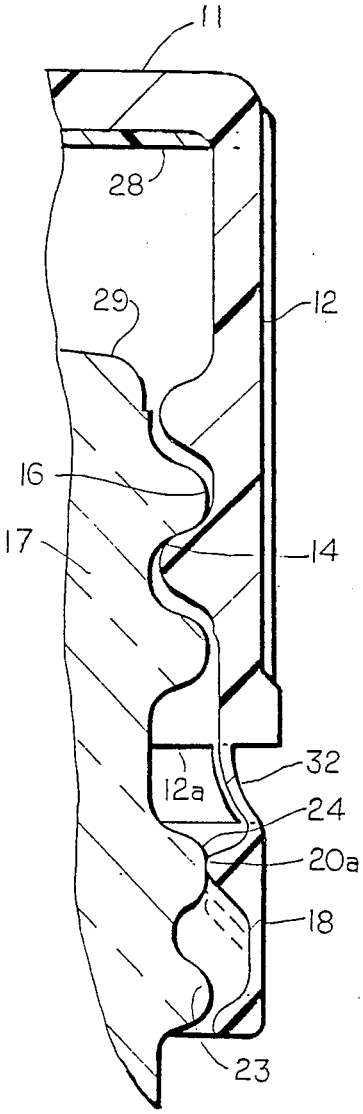

As is illustrated on FIGS. 8–10, threads 14 of the closure move along threads 16 of the container and the lower beads 20*c* on band 18 each engage upper locking ring 24. The lower surface 22 of the beads ride over the surface of ring 24 and below it. In succession, mid-level beads 20*b* do the same; and finally upper beads 20*a* follow suit. The sequence is repeated at the lower locking ring 23 on the container. Where the closure 10 is fully applied, beads 20 are all located below ring 23, as shown on FIGS. 5 and 6. In this full "on" position the gasket 28 in the top wall 11 of the closure seals against rim 29 of the container. The apex 30 of rim 29 forces itself into the yieldable gasket material and make a full annular seal against leakage of product.

Figure 5:
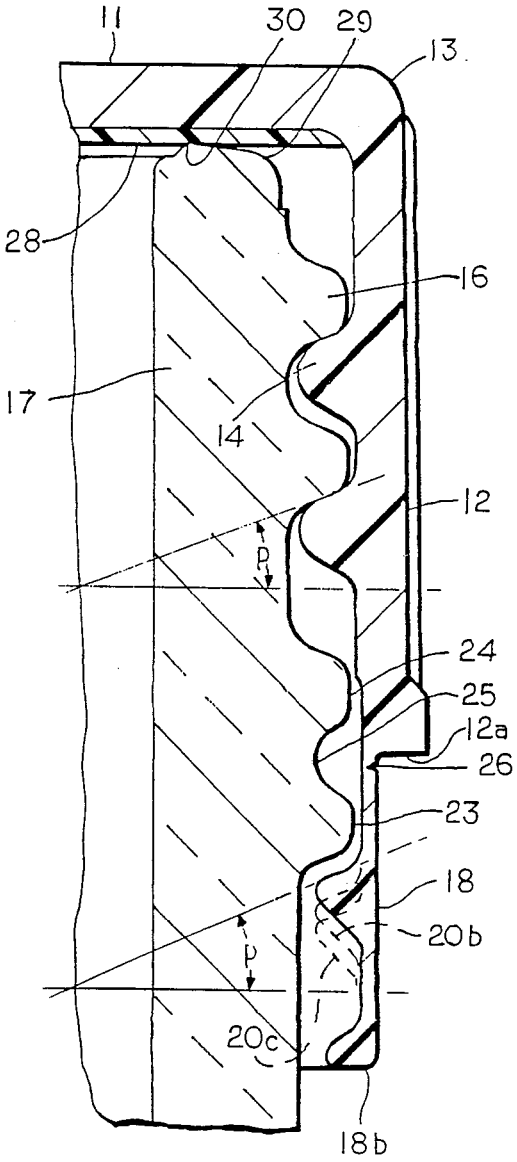
FIG. 5 is a sectional elevational view of one form of the closure in which a scored line of weakness forms a rupturable connection between the closure skirt and the tamper-indicating band.

In the embodiment of FIG. 5, the inside wall of the closure skirt 12 and band 18 is continuous and straight in an axial direction. The weakening line 26 is a v-shaped groove formed in the outside of the band wall. This groove is formed after the closure is molded by known technique using either continuous cutting wheel or serated cutting wheel. As the sealed closure is unscrewed on the container threads, the upper level of beads 20*a* raise to engage the under-surface of locking ring 23. Should band 18 distend itself, the other levels of beads 20*b* and 20*c* will similarly engage ring 23. This will hold band 12 from further axial movement and the stress imparted by unscrewing the closure further causes the band wall to break at the line of weakening at the annular groove 26.

Figure 6:
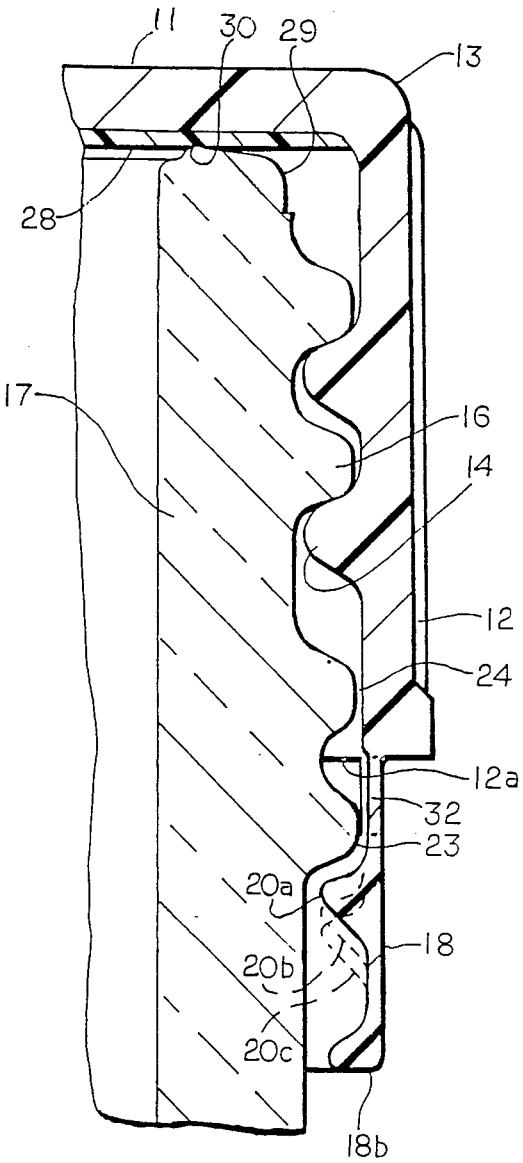
FIG. 6 is a sectional elevational view like FIG. 5 and illustrates a second embodiment of the closure in which molded bridges are formed to provide a rupturable connection between the band to the closure skirt.

A second type of rupturable connecting means is disclosed on FIG. 6. The tamper-indicating band of this embodiment is outwardly disposed and offset slightly from the interior of the skirt wall such that an annular series of circumferentially spaced-apart bridges 32 are formed between the lower edge 12*a* of the skirt and the band 18. The bridges 32 are molded as axial columns or posts of thin section and are rupturable. As shown on FIGS. 8–10, bridges 23 flex outwardly when the closure is applied and permit the several beads 20 to move over locking rings 23 and 24 on the container. In the opposite direction as the closure is unscrewed from the container, the bridges fail in tension and torsion as the beads 20 engage under the container's locking rings.

Figure 7:
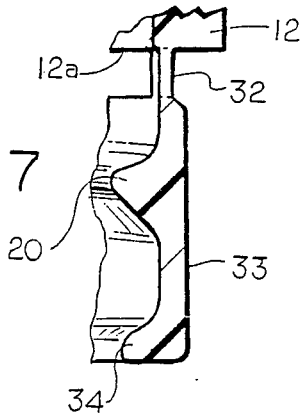
FIG. 7 is a fragmentary sectional elevational view of a third embodiment of the thickened form of tamper-indicating band with its rupturable connection to the closure skirt similar to that of FIG. 6.

Another embodiment of the invention is shown on FIG. 7 in which molded bridges 32 are integrally formed with a thickened band 33. There is a step 34 from each of the bridges 32 reaching outwardly to the upper end of band 33 thicker in cross-section. This band includes a lower annular section 34 that is substantially thicker than the wall of band 33 and is continuous circumferentially. The thick circular lower section 34 at the bottom of the band will assist initial capping of the closure on the container. The extra material also offers a heat shrink option to the bottler. Applying heat locally to the band section 34 will shrink it circumferentially adding further tamper-indicating assurance in the package.

The invention provides for progressively engaging beadlike projections of the closure tamper band with one or more annularly disposed locking rings on the neck finish of the container as the closure is unscrewed. As more beads come into contact with the container the band is separated from the closure along its weakened line leaving the band on the container as evidence it has been opened. The band inside diameter is greater than the exterior diameter of the container neck below the locking ring. The band will drop when severed or separated from the closure skirt and is not readily matched up and held in place when the closure is reapplied.

While the container illustrated is a glass container, it should be apparent the principles of this invention could be used with a plastic container or container of another material. The foregoing description is by way of example and constitutes a teaching of the best mode known for applying the principles of the invention. It is not intended to limit the scope of the invention to any extent greater than that set forth in the appended claims.

I claim:

1. A tamper-indicating closure comprising:

a one-piece closure molded of plastic having a base wall and a peripheral skirt, said skirt having means thereon adapted to interengage means on a container for securing it to the container, a tamper-indicating band on said closure joined to the closure along a weakened frangible line, a series of inwardly facing radial projections on said band circumferentially arranged around the interior of the band and disposed in plural tiers, each of said projections including a surface adapted to correspond with the means on the container for securing the closure enabling capping, said surface being adapted to engage a bead surface on the container when the closure is removed, the several projections in tiers assuring holding the band with the container while severing it from the closure along the weakened line during removal.

2. The closure of claim 1 wherein the said series of projections in each tier of the plural tiers are equally spaced and the projections of one tier are circumferentially offset from the projections of an adjacent tier.

3. The closure of claim 1 wherein the weakened line comprises a circumferential score line.

4. The closure of claim 1 wherein the weakened line comprises bridges reduced in cross section from the cross section of the band.

5. The closure of claim 1 wherein there are three tiers of the projections on the inside wall of the band.

6. A tamper-indicating closure adapted to be combined with a container having a threaded neck finish and an annular exterior finish bead disposed axially below the threads, the closure comprising a base wall and integrally molded peripheral skirt, threads on the inside surface of said skirt engageable with the threads of said neck finish for applying the closure and removing the closure on the container, a tamper-indicating band joined to the skirt along a weakened frangible line, a plurality of bead-like projections on the inside surface of the band arranged in tiers disposed axially of the band, the bead-like projections each including a first surface which has an angular pitch substantially similar to the pitch of the neck finish threads on the container and a second cam surface tapered axially and outwardly below said first surface, said first surface cooperating with said finish threads during applying the threaded closure in a threading fashion and said second surface camming said projection past the annular bead of the container said surface being adapted to oppose the removal of the band past the container bead at the removal of the closure, whereupon said band is separated along the weakened frangible line.

7. A molded plastic closure for a container including a neck with threads having an angular pitch for applying and removing the closure and an annular locking ring portion axially below the neck threads comprising a cap portion having a top wall and a cylindrical threaded skirt portion to cooperate with the neck threads of the container for applying and removing the closure, and tamper-indicating band means connected to the skirt portion by a weakened manually fracturable area, said band means including a plurality of inwardly directed projections whose innermost surfaces define a circle having a diameter less than that of said locking ring portion of the container and including a first angular surface that is substantially the same as the angular pitch of the neck threads, and a second cam surface extending axially and radially below said first surface, said first angular surface cooperating with the neck threads and following same in on-screwing the closure and said second surface camming the projection axially below the locking ring, said projections when disposed below the locking ring portion have their said first surface interfere with said ring portion upon off-screwing the closure to sever the band from the skirt at said weakened fracturable area.

8. A closure for a container having a neck including a locking ring portion, comprising:

a cap having a top wall portion and a skirt portion depending integrally therefrom, and tamper-indicating band means joined to said skirt portion, said band means including a plurality of inwardly extending interrupted bead means, said interrupted bead means being adapted to move below said locking ring portion during application of said closure to said container, and to engage said locking ring portion during removal of said closure from said container whereby said tamper-indicating band means resists removal of said closure from said container, said interrupted bead means being arranged peripherally on the inside surface of said band means and disposed in plural tiers, bead means disposed in one such tier being offset from bead means in the adjacent such tier.

9. A closure in accordance with claim 8, wherein each of said bead means includes a lower camming portion adapted to engage said locking ring during relative axial displacement of said closure onto said container whereby said bead means are urged outwardly and past said locking ring.

10. A closure in accordance with claim 8, wherein said bead means each include a surface adapted to engage said locking ring portion during axial displacement of said closure in its removal from said container whereby said band means resists rotation on said container.

11. A closure in accordance with claims 9 or 10 wherein each of said bead means extends radially inwardly of said closure.

12. A closure for a container having a threaded neck including an annular locking ring, comprising:

a plastic cap having a top wall portion, and an internally threaded, generally cylindrical skirt portion depending from said top wall portion, and a tamper-indicating band depending from and connected to said skirt portion, said band including an annular band portion, and a plurality of circumferentially spaced projections extending integrally inwardly of said band portion, said projections being disposed in plural tiers on the band portion and each of said projections being adapted to move past said locking ring during application of said closure to said container, said projections being dimensioned to engage said locking ring and the portion of said container neck adjacent said locking ring during removal of said closure from said container.

13. A closure in accordance with claim 12, wherein said skirt portion and said tamper-indicating band are connected to each other by fracturable means including a plurality of fracturable bridges extending between said skirt portion and said tamper-indicating band.

14. A closure in accordance with claim 12, wherein said tamper-indicating band includes at least one area of relatively reduced strength adapted to fracture during removal of said closure from said container.

15. A tamper-indicating closure comprising:

a plastic cap having a top wall portion, and a generally cylindrical skirt portion depending from said top wall portion, and a tamper-indicating band depending from said skirt portion, said band including an annular band portion, and a plurality of circumferentially spaced bead-like projections extending integrally inwardly of said band portion, said projections being disposed in plural tiers and the projections in one tier offset from projections in the adjacent tier.

16. A tamper-indicating closure in accordance with claim 15, and fracturable means joining said tamper-indicating band and said skirt portion comprising a plurality of frangible bridges.

17. A tamper-indicating closure in accordance with claim 15, wherein each of said projections includes a camming surface portion and a locking surface portion.

18. A closure for a container having a threaded neck including annular spaced apart locking rings comprising:

a plastic cap having a top wall portion, and an internally threaded, generally cylindrical skirt portion depending from said top wall portion, and a tamper-indicating band depending from said skirt portion and distinguished therefrom by fracturable means, said tamper-indicating band including an annular band portion, and a plurality of integral, circumferentially spaced, bead-like projections extending inwardly of said band portion and arranged in plural tiers, said projections of one tier being offset from those of another tier, each of said projections being adapted to move past said locking rings during application of said closure to said container, said projections being dimensioned to engage one of said locking rings during removal of said closure from said container so as to cause fracture of said fracturable means and separate the band and closure.

19. A closure in accordance with claim 18, wherein said fracturable means includes a plurality of circumferentially spaced fracturable bridges extending between the lower edge of said skirt portion and said band portion.

20. A tamper-indicating plastic closure for use on a container having a locking ring comprising a top wall and a depending peripheral skirt, said skirt having internal means adapted to engage means on the container upon relative rotation of the closure and container, a weakened, frangible means connecting said band to the lower edge of said skirt, and a plurality of circumferentially extending and circumferentially spaced relatively rigid locking members that are arranged in axially spaced tiers on the interior surface of said band, each extending inwardly and adapted to engage the locking ring of the container.

21. A method of applying a threaded tamper-indicating closure to a threaded finish of a container primarily by rotational forces and without substantially top loading the closure, said closure having a tamper-indicating band attached to the lower edge of the skirt by rupturable means, comprising the steps of providing threads in the container finish defining a pitch angle and an annular tamper ring below the threads, providing threads in the skirt of the closure having a pitch angle complementary to the pitch angle of the container finish threads, providing plural spaced apart, integral beads on the inside of the tamper-indicating band that are circumferentially arranged thereon, said beads having an angular upper surface that is sloped complementary to said pitch angle, rotating the closure on the finish to apply the closure, said upper surface of the tamper beads engaging the container threads in a line contact for traversing them beyond the container threads and to the tamper ring, said closure threads engaging the container threads and driving the tamper beads below the tamper ring to a position closing the container whereat said beads are adapted to engage said ring upon opening the container and cause the rupturable means to sever the band from the skirt.

22. The method of claim 21 which includes applying heat locally to the lower end portion of the tamper-indicating band on the closed container for shrinking said portion circumferentially on the container below the tamper ring thereby enhancing the tamper indicating performance of the closure.

* * * * *